US005771621A

United States Patent [19]

Rogers

[11] Patent Number: 5,771,621

[45] Date of Patent: Jun. 30, 1998

[54] BALL PITCHING MACHINE

[76] Inventor: Harold W. Rogers, 825 McKinney, Arlington, Tex. 76012

[21] Appl. No.: 805,131

[22] Filed: Feb. 24, 1997

[51] Int. Cl.[6] ..... A63B 65/12

[52] U.S. Cl. ..... 42/55; 124/56; 89/7

[58] Field of Search ..... 124/61, 63, 64, 124/65, 71, 75, 76, 77, 73, 56; 273/108.31, 129 AD; 89/7; 42/55

[56] References Cited

U.S. PATENT DOCUMENTS

| | | | |
|---|---|---|---|
| 645,932 | 3/1900 | Beck et al. | 89/7 |
| 1,405,664 | 2/1922 | Boileau . | |
| 2,505,428 | 4/1950 | Pope | 124/65 |
| 2,630,108 | 3/1953 | White | 124/65 |
| 3,838,676 | 10/1974 | Kahelin | 273/26 R |
| 4,109,557 | 8/1978 | Zaucha | 89/7 |
| 5,496,025 | 3/1996 | Phillips et al. | 273/26 D |
| 5,640,945 | 6/1997 | Slonaker et al. | 124/56 |

*Primary Examiner*—Stephen M. Johnson
*Attorney, Agent, or Firm*—David W. Quimby

[57] ABSTRACT

A portable ball pitching machine for projecting a ball uses a combusting gas to drive a piston which compresses air behind a ball and propels the ball through a barrel. A combustible mixture of air and propane are introduced into a combustion chamber, and a ball is loaded against an air exit of a barrel housing. The gas is ignited in the combustion chamber, and the explosion drives a piston through a compression chamber and generates compressed air. The compressed air is directed through the barrel housing to the air exit and the ball, and the ball is propelled from the barrel. The azimuth and elevation position of the barrel are adjustable. The velocity of a projected ball is adjustable by adjusting a regulator which vents to the atmosphere a portion of the compressed air that would otherwise be directed against the ball.

16 Claims, 5 Drawing Sheets

BALL PITCHING MACHINE

BACKGROUND OF THE INVENTION (1) Field of the Invention

This invention relates to ball pitching devices, and more particularly to a ball pitching device which uses an ignitable gas to generate compressed air which propels a ball. The barrel of the device can be changed to accommodate different diameter balls, such as baseballs, softballs, and tennis balls. Adjustments can be made to the position of the barrel to control the azimuth and elevation of a propelled ball (2) Description of Related Art Practice is required to become proficient at most sports. For baseball and softball, a player needs to practice both hitting and fielding. A wide variety of ball throwing devices exist to help a ball player practice. These devices include pneumatic ball throwing machines, rotary wheel ball throwing machines, and spring mechanism ball throwing machines.

Many of the prior art ball throwing machines are heavy and are not easily transportable to a practice area. Also, some of the prior art ball throwing machines require attachment of a power source to the throwing machine by means of a power cord or a compressed air line connected to a compressor. Most practice areas are fields which do not have convenient access to an electrical power supply or are not equipped with compressed air lines. It is desirable to have a ball pitching machine which is easily transportable, and which uses an easily transportable power source to propel a ball.

For baseball and softball practice, a player needs to practice both hitting and fielding. Fielding practice includes catching both grounders and fly balls. Many prior art pitching machines have a small target area which the pitching machine can throw to. These machines are used primarily for batting practice. Because of the limited target range, these pitching machine are of minimal use for fielding practice. It is desirable to have a pitching machine which has a large target range to which a ball can be pitched, so that the machine can be used for fielding practice and for batting practice.

SUMMARY OF THE INVENTION (1) Progressive Contribution to the Art

I have invented a portable ball pitching machine which uses an ignitable gas to generate compressed air to propel a ball. The ball pitching machine comprises a combustion chamber, a compression chamber, a power piston and a compression piston connected in working relation in the combustion chamber and the compression chamber, a barrel housing, a barrel, and a combustible gas supply. A ball is loaded into the barrel and is seated against the barrel housing. A combustible gas is introduced into the combustion chamber, and the gas is ignited by an igniter. The explosion of the combustible gas drives the compression piston through the compression chamber and compresses the air between the compression piston and the ball. The compressed air propels the ball through the barrel. The explosion of the combustible gas is totally contained within the combustion chamber, so in operation, the ball pitching machine is quiet.

Azimuth and elevation adjustments can be made to the barrel so that the direction and elevation of a projected ball can be controlled. This allows the ball pitching machine to be used for both batting practice and for fielding practice. A regulator located in the barrel housing allows the velocity of a propelled ball to be controlled.

The ball pitching machine can throw a curve ball. An elastomeric strip is located on an inside surface of the barrel. The position of the elastomeric strip is adjusted by rotating the barrel. As a ball is expelled from the barrel, the elastomeric strip causes the ball to spin which results in a curve ball. Right or left spin relative to the ground can be controlled by adjusting the position of the elastomeric strip by rotating the barrel.

(2) Objects of this Invention

An object of this invention is to provide a ball pitching machine which uses a combusting gas to generate compressed air to propel a ball.

Another object is to provide a ball pitching machine which can throw a curve ball by means of an elastomeric strip located in a barrel of the machine which imparts a spin to a ball projected through the barrel.

Another object is to provide a ball pitching machine with allows the velocity, azimuth and elevation of a propelled ball to be controlled before the ball is pitched.

Another object is to provide a ball pitching machine which uses a combustible gas stored in a readily transportable container (such as a small propane tank commonly used for outdoor cooking grills) to power the ball pitching machine.

Further objects are to achieve the above with a device which is sturdy, compact, durable, light-weight, simple, safe, efficient, versatile, ecologically compatible, energy conserving and reliable; yet is inexpensive and easy to manufacture, install, maintain and use.

Other objects are to achieve the above with a method that is rapid, versatile, ecologically compatible, energy conserving, efficient, inexpensive, and does not require highly skilled people to install, maintain or use.

The specific nature of the invention, as well as other objects, uses, and advantages thereof, will clearly appear from the following description and from the accompanying drawings, the different views of which are not necessarily scale drawings.

DESCRIPTION OF THE PREFERRED EMBODIMENTS

Figure 1:
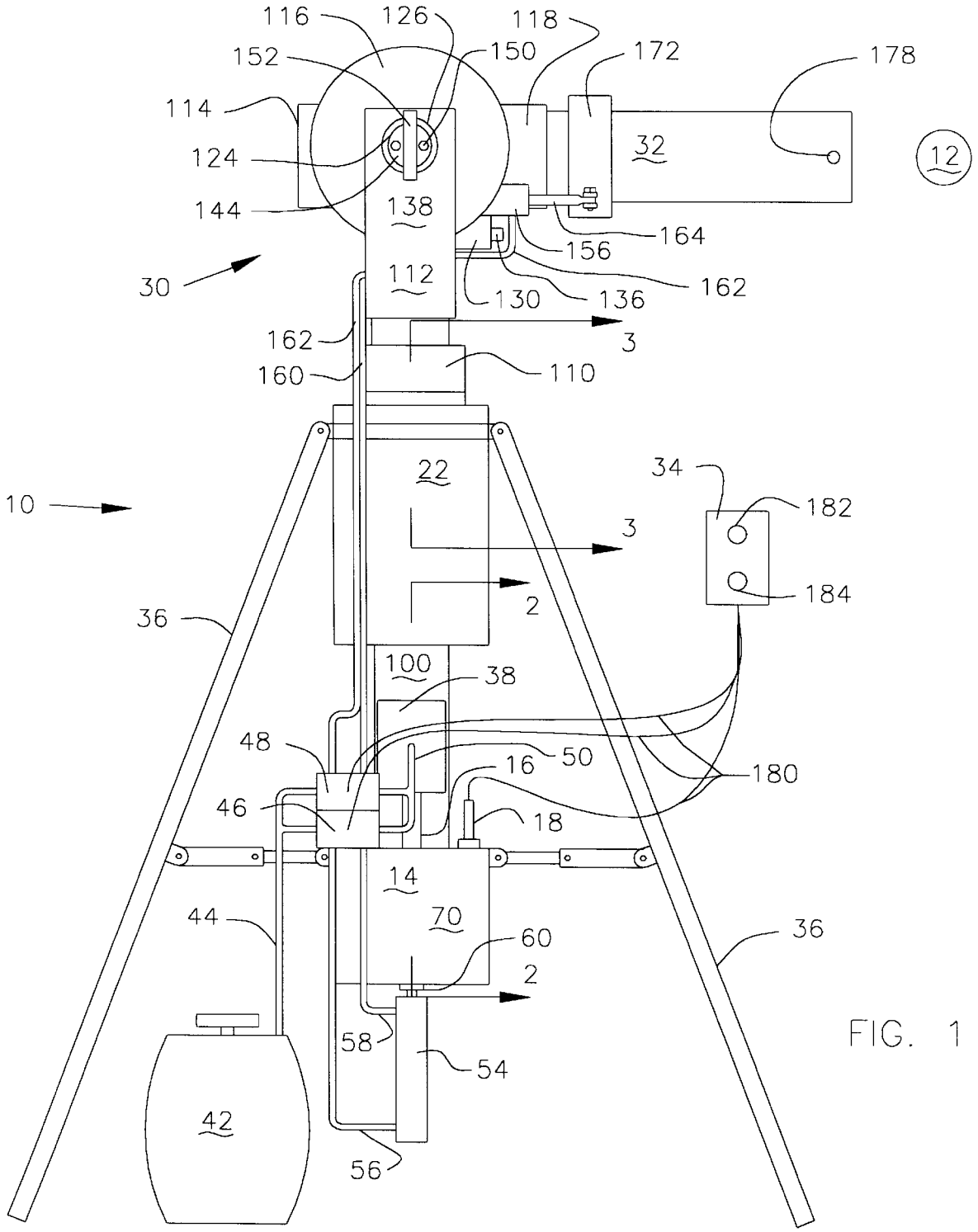
FIG. 1 is a front elevational view of the ball pitching machine.

With reference to the drawings, the ball pitching machine is designated generally as 10. The ball pitching machine 10 uses a combusting gas to generate compressed air to propel ball 12. The ball pitching machine 10 has combustion chamber 14 with combustible gas supply line 16 and igniter 18; purge piston 20 in the combustion chamber for expelling exhaust gases from the combustion chamber; compression chamber 22; power piston 24 in the combustion chamber; compression piston 26 in the compression chamber; connector rod 28 connecting the power piston to the compression piston; barrel housing 30; barrel 32; and control panel 34. The ball pitching machine is supported by tripod frame 36.

A combustible gas is supplied to the combustion chamber 14 through gas supply line 16 from gas intake valve 38. Air is supplied to the combustion chamber through air intake valve 40. The combustible gas is stored in gas tank 42. Preferably, the combustible gas is propane, and the gas tank 40 is a portable gas tank of the type commonly used for outdoor cooking grills. The gas from the gas tank 42 passes into input line 44 to four-way purge solenoid valve 46, and to four-way ball loading solenoid valve 48. Discharge gas from the purge solenoid valve 46 and discharge gas from the ball loading solenoid valve 48 pass through discharge line 50 to supply chamber 52 of the gas intake valve 38.

Purge piston 20 is located in the combustion chamber 14. The purge piston 20 is connected to purge cylinder 54. To purge exhaust gases from the combustion chamber 14, the purge solenoid valve 46 is activated so that gas from the gas tank 42 passes through lower purge cylinder line 56 to the purge cylinder 54, and discharge gas from the purge cylinder passes through upper purge cylinder line 58 through the purge solenoid valve to the supply chamber 52 of the gas intake valve 38. The entrance of combustible gas into the purge cylinder 54 causes purge cylinder arm 60 to extend from the purge cylinder 54 and moves the purge piston 20 away from bumper pad 62. Initial extension of the arm 60 moves seal plate 64 away from the purge piston 20 before the purge piston is moved, thus opening exhaust ports 66. When arm shoulder 68 contacts the purge piston 20, the purge piston moves forward with further extension of the purge cylinder arm 60. As the purge cylinder arm 60 continues to extend, arm shoulder 68 drives the purge piston 20 towards the top of lower section 70 of the combustion chamber 14, and exhaust gases pass through the exhaust ports 66.

To introduce a new combustible gas mixture in the combustion chamber 14, purge solenoid valve 46 is activated so that gas from the gas tank 42 passes through upper line 58, and gas from the lower line 56 passes through the purge solenoid valve to the supply chamber 52 of the gas intake valve 38. This causes the purge cylinder arm 60 to retract back into the purge cylinder 54. Initial movement of the purge cylinder arm 60 causes the seal plate 64 to seal the exhaust ports 66 before the purge piston 20 moves. Further arm 60 movement draws the purge piston 20 back to the bumper pad 62 and expels the exhaust gases through exhaust outlet 72. The retraction of the purge piston 20 through the combustion chamber 14 draws into the combustion chamber a fresh charge of combustible gas and air through gas intake valve 38 and air intake valve 40.

Figure 2:
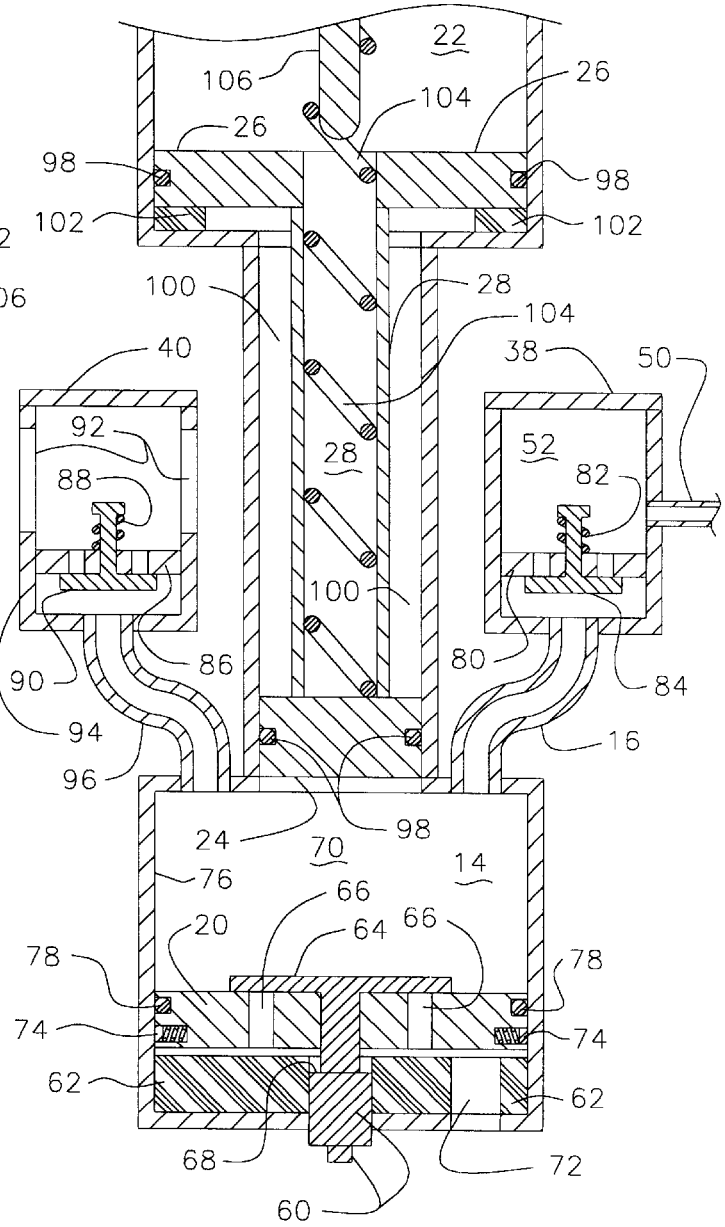
FIG. 2 is a sectional view of the ball pitching machine taken substantially along line 2—2 of FIG. 1 showing the combustion chamber, purge piston, power piston, compression piston, and gas and air intake valves.

As shown in FIG. 2, the purge piston 20 has spring-loaded plungers 74 which drag against combustion chamber inside wall 76, and a piston ring 78. The plungers 74 create resistance to motion of the purge piston 20, which allows the exhaust ports 66 to be opened and closed by the seal plate 64.

The gas intake valve 38 has gas supply chamber 52, separator plate 80, spring 82 and seal plate 84. Combustible gas is supplied to the supply chamber 52 from gas discharge line 50. The separator plate 80 separates the gas supply chamber 52 from the combustion chamber 14. Spring 82 and seal plate 84 prevent gas from the combustion chamber 14 from passing into the supply chamber 52. The spring 82 and the seal plate 84 only allow gas to pass into the combustion chamber through gas supply line 16 when the purge piston 20 is being retracted through the combustion chamber towards bumper pad 62.

The air intake valve 40 has separator plate 86, spring 88, and seal plate 90. Spring 88 and seal plate 90 prevent gas from the combustion chamber 14 from passing through the air intake valve 40 to the atmosphere. When purge piston 20 is retracted through the combustion chamber towards bumper pad 62, the spring 88 is compressed by the vacuum that the purge piston draws, and air passes into the valve 40 through a plurality of slots 92 in valve wall 94. The air drawn through slots, 92 passes into the combustion chamber 14 through air supply line 96.

Figure 3:
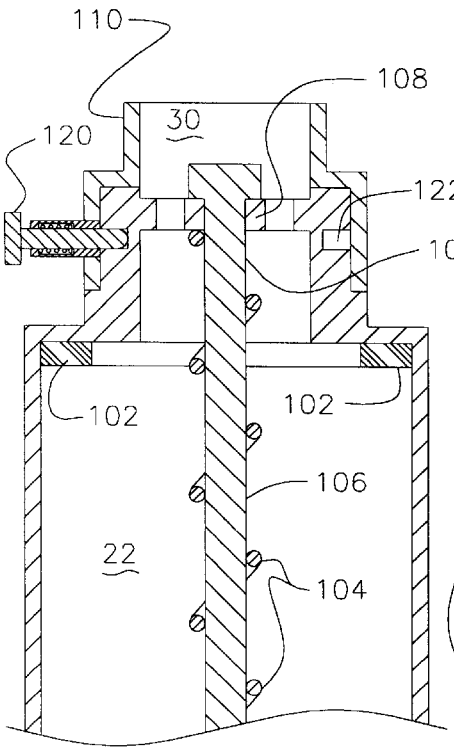
FIG. 3 is a sectional view of the ball pitching machine taken substantially along line 3—3 of FIG. 1 showing the connection between the compression chamber and the barrel housing.

As shown in FIG. 2, the power piston 24 is connected by connector rod 28 to the compression piston 26. The power piston 24 and the compression piston each have piston ring 98. The power piston 20 travels throughout upper section 100 of the combustion chamber 14, and the compression piston 26 travels throughout the compression chamber 22. The compression piston 26 hits bumper pads 102 at the end of each stroke. Spring 104 returns the pistons 24, 26 to an initial position after an explosion in the combustion chamber 14. The spring 104 is guided by the connector rod 28 and by guide rod 106. The guide rod is supported from guide rod support 108, as shown in FIG 3.

The barrel housing 30 comprises connector section 110, outer U shape section 112, inner U shape section 114, elevation locking discs 116, and ball loading tube 118. The connector section 110 attaches to the compression chamber 22 by means of pull pin 120 which fits in groove 122 of the compression chamber. The azimuthal direction of the barrel 32 can be controlled by rotating the barrel housing 30 about the pin and groove connection 120, 122.

The outer U shape section 112 connects to the inner U shape section 114 at trunnions 124 by means of trunnion seals 128. The elevation of the barrel 32 can be adjusted by rotation of the barrel about the trunnions 124. The elevation of the barrel 30 can be held in a desired position by setting elevation lock 128.

Figure 6:
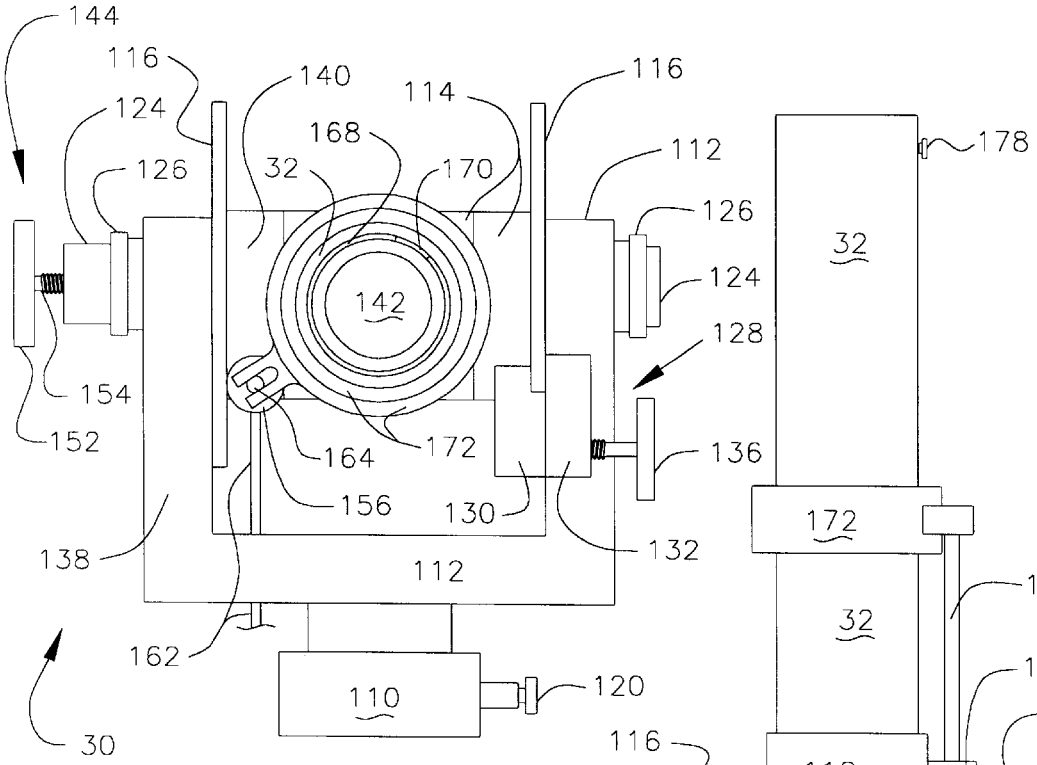
FIG. 6 is a right side elevational view of the barrel housing and barrel of the ball pitching machine, without a small diameter barrel positioned within the barrel, with the barrel in a horizontal position with respect to the ground.

The elevation lock comprises block 130, and 132, which are connected by threaded shaft 134 and handle 136. The two blocks 130, 132 are separated by an elevation locking disc 116. When the handle 136 is tightened, the threaded shaft 134 draws block 130 towards block 132, and the elevation of the barrel 32 is locked in place. When the handle 136 is loosened, the threaded shaft 134 separates blocks 130 and 132, and the elevation of the barrel 32 can be adjusted. The elevation lock is shown in FIG. 6.

Figure 5:
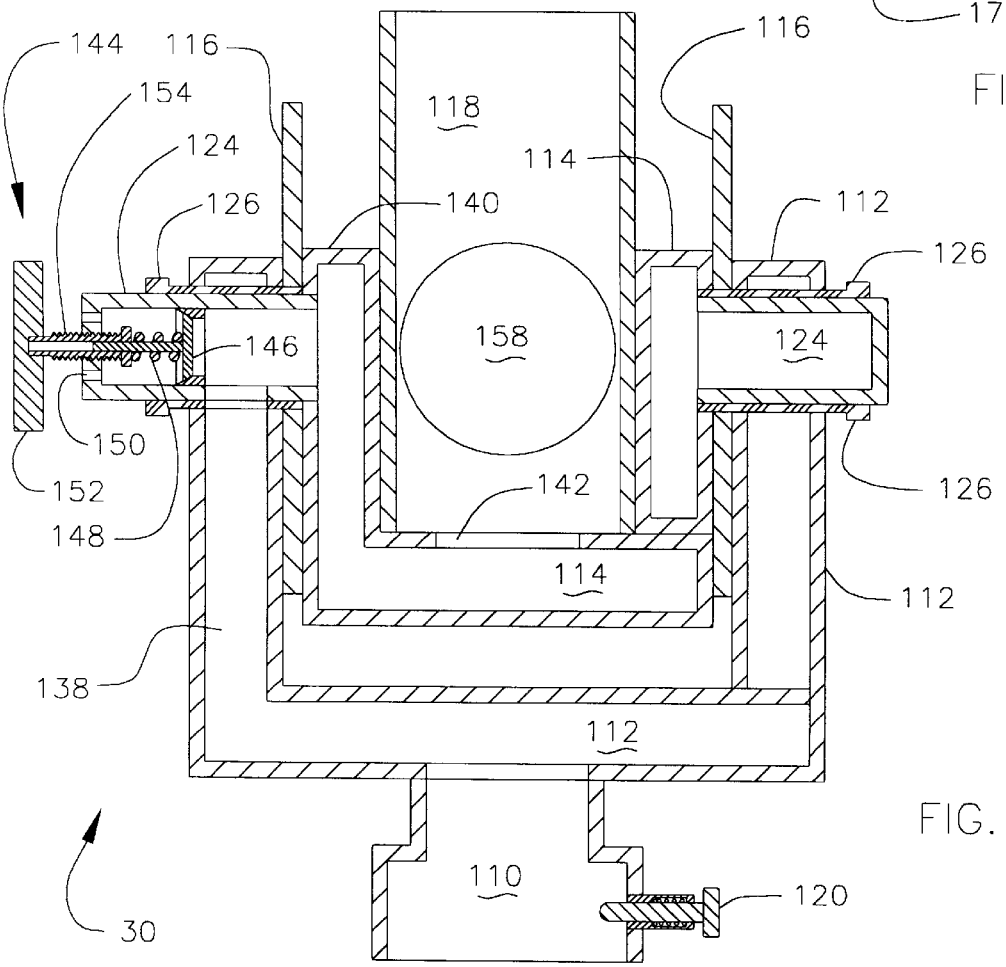
FIG. 5 is a sectional view of the barrel housing of the ball pitching machine with the ball loading tube in a vertical position with respect to the ground.

The ball loading tube 118 is located between the two legs of the inner U shape section 114, as shown in FIG. 5. After an explosion of combustible gas in the combustion chamber 14, compressed air from the compression chamber 22 passes through the connector section 110, through outer U shape section leg 138; through trunnion 124; through inner U shape section leg 140; to air exit 142. Air regulator 144 is located in trunnion 124.

When compressed air travels from the compression chamber 22 through the barrel housing 30, a portion of the compressed air is directed against valve plate 146 of the air regulator 144. Spring 148 allows the valve plate 146 to move, which allows a portion of the compressed to vent through air exhaust ports 150. Turning handle 152 rotates threaded shaft 154, which increases or decreases the tension in spring 148 and determines the range of motion for the valve plate 146. A section view of the air regulator 144 is shown in FIG. 5.

Figure 7:
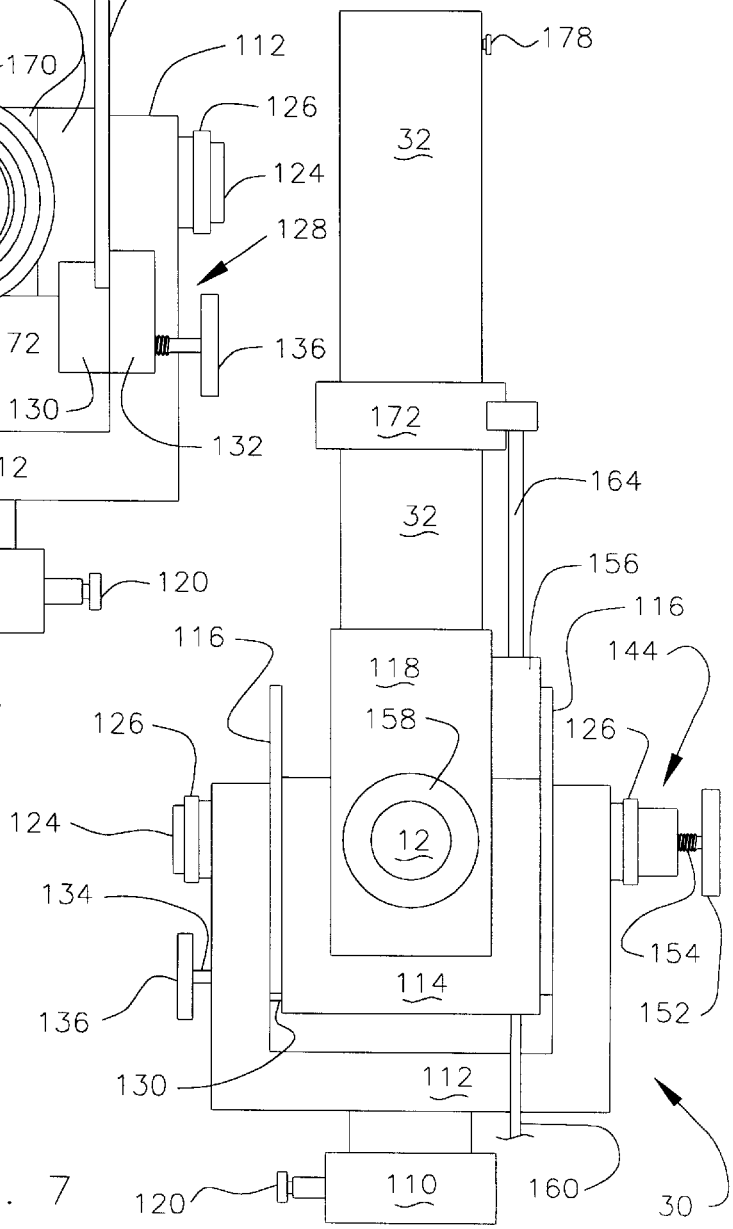
FIG. 7 is a left side elevational view of the barrel housing and barrel of the ball pitching machine with the barrel in a vertical position with respect to the ground, showing the exposed ball loading cutout.

The barrel 32 slides within the ball loading tube 118 and the barrel is connected to the barrel loading tube 118 by ball loading cylinder 156. When the barrel 32 is in a forward position, as shown in FIG. 7, ball entrance cutout 158 in the ball loading tube 118 is exposed and allows a ball 12 to be fed into the ball pitching machine 10. A gravity type ball loader (not shown) can be attached above the ball entrance cutout 158 to feed balls 12 into the ball entrance cutout when the ball entrance cutout is open, or a person can manually feed a ball into the ball entrance cutout when the ball entrance cutout is open.

Lower line 160 and upper line 162 connect the ball loading cylinder 156 to the ball loading solenoid valve 48. A portion of the gas lines 160, 162 are flexible so that azimuth and elevation adjustments can be made to the barrel 32. The discharge line 50 from the ball loading solenoid valve 48 is connected to the supply chamber 52 of the gas intake valve 38. The input line 44 of the ball loading solenoid valve 48 is connected to the gas tank 42. To expose the ball entrance cutout 158, the ball loading solenoid valve 48 is activated so that gas from the gas tank 42 is directed through lower line 160 and gas from the upper line 162 is directed to the supply chamber 52 of the gas intake valve 38, which causes ball loading cylinder arm 164 to extend. As the cylinder arm 164 extends, the barrel 32 slides outwards and exposes the ball entrance cutout 158. To close the ball entrance cutout 158, the ball loading solenoid valve 48 is activated so that gas from the gas tank 42 is directed through the upper line 162 and gas from the lower line 160 passes to the supply chamber 52 of the gas intake valve 38, which causes the cylinder arm 164 to retract and close the ball entrance cutout.

Figure 4:
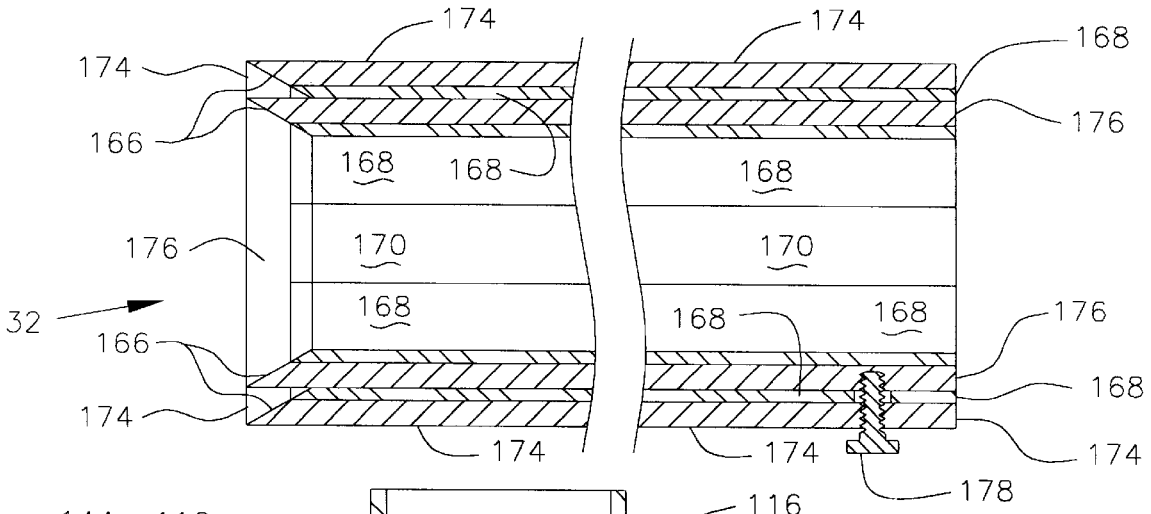
FIG. 4 is a sectional view of the barrel of the ball pitching machine with a removable small diameter barrel positioned in a larger diameter barrel and held in place by a thumb screw.

As shown in FIG. 6 and FIG. 4, the barrel 32 of the pitching machine 10 is a tube with tapered end 166. The tapered end 166 ensures that a ball 12 that is fed into the ball entrance cutout 158 will seat against the air exit 142 when the ball loading cylinder arm 164 is fully retracted. The inside diameter of the barrel 32 should have a diameter slightly greater than the diameter of a ball 12 to be pitched from the pitching machine 10. The inside surface of the barrel preferably has a polymeric lining 168, such as TEFLON.

Also, elastomeric strip 170 can be longitudinally located on the inside surface of the barrel 32. As a ball 12 is projected through the barrel 32, the elastomeric strip 170 will provide resistance to the motion of the ball. This will cause the ball 12 to roll through the barrel 32 which will result in a spin being imparted to the ball. The spin imparted on the ball 12 changes the flight characteristic of the projected ball, and results in a curve ball. The type of curve depends on the position of the elastomeric strip 170 with respect to the ground. The barrel 32 is connected to the ball loading cylinder arm 164 by bearing 172 so that the position of the elastomeric strip 170 can be changed by rotation of the barrel.

To accommodate different size balls 12, the ball loading tube 110 is sized to hold large barrel 174 which will project the largest ball to be used with the pitching machine 10. Typically, this would be a softball barrel. Smaller alternate barrel 176, such as a baseball barrel, that can accommodate a smaller diameter ball can be slid into the large barrel 174 and be held in place by a thumb screw 178, as illustrated in FIG. 4. The non-tapered ends of the large barrel 174 and the small barrel 176 can be scribed or otherwise marked (not shown) to aid aligning the barrels so that the thumb screw 178 can connect the barrels together.

The control panel 34 for the pitching machine 10 is connected by wiring 180 to an electrical power source (not shown) such as a battery, to the purge solenoid valve 46, and to the ball loading solenoid valve 48. The control panel 34 has fire button 182, which is connected to the igniter 18; and load button 184, which is connected to both the purge solenoid valve 46 and the ball loading solenoid valve 48. When the fire button 182 is depressed, the igniter 18 will produce a spark in the combustion chamber 14.

When the load button 184 is depressed, the ball loading solenoid valve 48 and the purge solenoid valve 46 are cycled. Cycling the ball loading solenoid valve 48 causes the ball loading cylinder arm 164 to first extend, allowing a ball 12 to be loaded into the ball pitching machine 10; and then to retract, causing the loaded ball to be positioned against the air exit 142 of the ball housing 30. Cycling the purge solenoid valve 46 causes the purge cylinder arm 60 to first extend, expelling exhaust gas from the combustion chamber 14; and then to retract, causing air and combustion gas to be drawn into the combustion chamber from the air intake valve 40 and the gas intake valve 38.

To use the ball pitching machine 10, the gas tank 42 is connected to the supply line 44 of the purge solenoid valve 46 and the ball loading solenoid valve 48. The load button 184 of the control panel 34 is depressed to cycle the purge and ball loading cylinders 54 and 156, which will load a ball 12 into the ball pitching machine 10 and a combustible gas mixture into the combustion chamber 14.

If the machine 10 is being used for the first time, or after a long period of disuse, the load button 184 should be activated two times, while care is used to allow only one ball 12 to be loaded into the ball pitching machine. The first load cycle will result in air being displaced from the solenoid valve lines 56, 58, 160, 162 by gas from the gas tank 42, and air will be discharged into the combustion chamber 14 from the supply chamber 52 of the gas intake valve 38. The second load cycle will result in combustion gas being sent to the combustion chamber 14 from the supply chamber 52 of the intake valve 38.

After the ball pitching machine 10 has been loaded, the azimuth and elevation positions of the barrel 32 are adjusted. The azimuth position is adjusted by rotating the ball housing about the pin and groove connection 120, 122. The elevation position of the barrel 32 is adjusted by rotating the barrel about the trunnions 124. When the desired elevation position is obtained, elevation lock 128 is set to hold the desired elevation position. If a barrel 32 which has an elastomeric strip 170 is used, the position of the strip is adjusted to a desired position by rotation of the barrel as allowed by bearing 172. The velocity of the ball 12 to be pitched is controlled by setting the regulator 144.

After the positioning adjustments are made, the ball 12 is propelled by depressing the fire button 182 of the control panel 34. Depression of the fire button 182 causes the igniter 18 to produce a spark in the combustion chamber 14. The gas in the combustion chamber 14 explodes and drives the power piston 24 and the compression piston 26 forward. The air above the compression piston 26 is compressed by the forward stroke of the compression piston. The compressed air is directed from the compression chamber 22 to the air exit 142 and the ball 12. The compressed air drives the ball 12 out of the barrel 32. The power piston 24 and the compression piston 26 are returned to their initial position by the spring 104. The process can be repeated to propel another ball 12.

Figure 8:
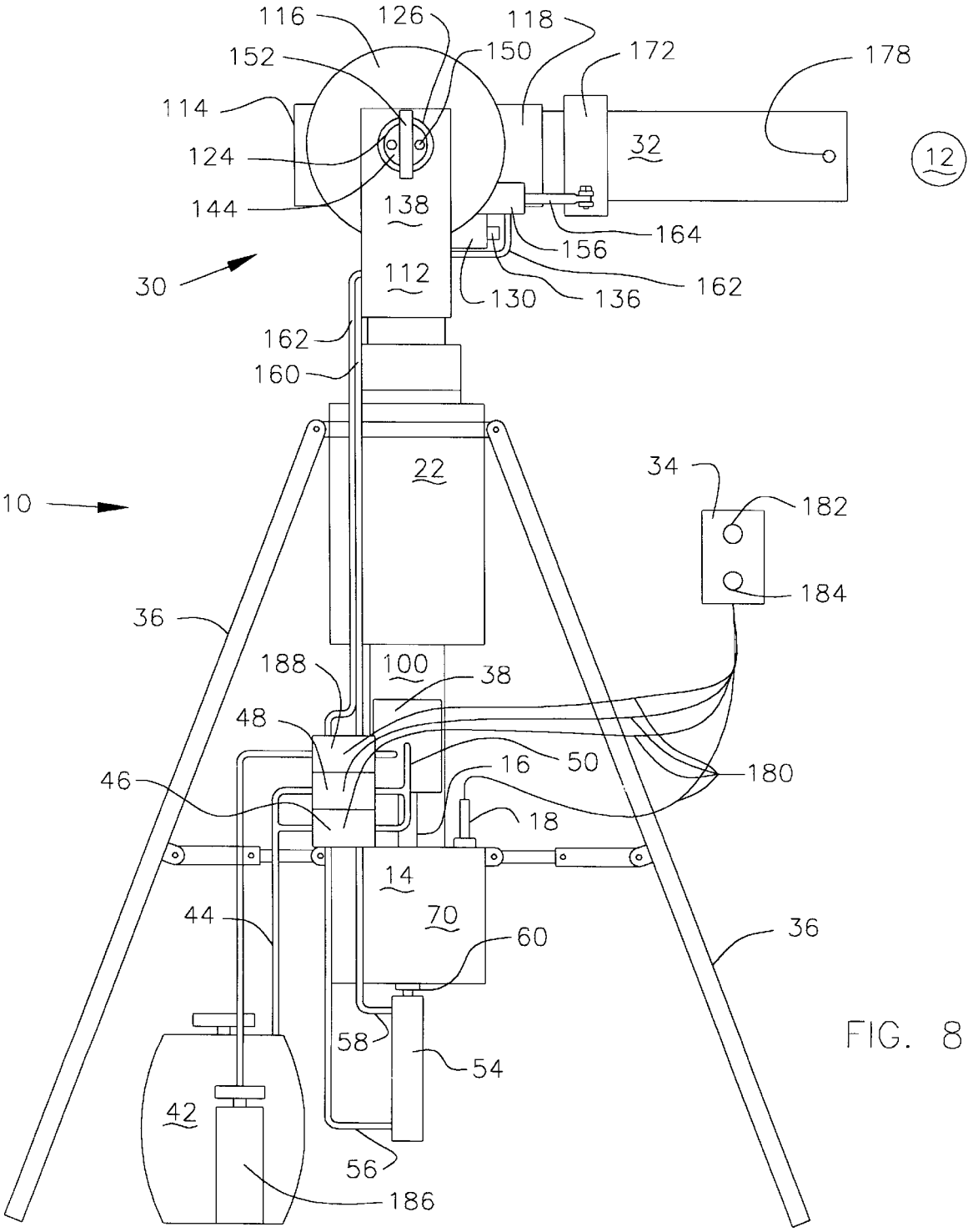
FIG. 8 is a front elevational view of the ball loading machine with an oxygen cylinder connected to the gas intake valve.

To ensure explosion of the combustible gas in the combustion chamber 14 when the igniter 18 is triggered, an oxygen supply tank 186 can be connected to the gas intake valve 38 to enrich the oxygen content of the combustion gas mixture in the combustion chamber. The oxygen would pass from the oxygen supply tank 186 through two-way solenoid valve 188, which is connected by wiring 180 to the load button 184 of the control panel 34, and into the gas intake valve 38, as shown in FIG. 8. Activating the load button 184 will cause a small amount of oxygen to be fed into the supply chamber 52 of the gas intake valve 38.

The ball pitching machine 10 described above uses a combusting gas as a power source to drive a compression piston 26 through a compression chamber 22 to generate compressed air which propels a ball 12. Alternatively, another power source, such as an electric motor, a spring mechanism, or a combination of an electric motor and a spring mechanism, could be used to drive the compression piston 26 through the compression chamber 22 to generate compressed air to propel the ball 12.

The embodiments shown and described above are only exemplary. I do not claim to have invented all the parts, elements, or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A method of projecting a ball from a ball pitching machine comprising:

a) loading a ball against an air exit of a ball housing and an end of a barrel;

b) feeding a combustible gas into a combustion chamber;

c) igniting the combustible gas in the combustion chamber;

d) said ignition of the combustible gas driving a compression piston through a compression chamber to produce a volume of compressed air;

e) directing the compressed air to the air exit of the ball housing; and f) driving the ball out of the barrel with the compressed air.

2. The method of projecting a ball from a ball pitching machine as defined in claim 1 further comprising adapting the ball pitching machine to pitch smaller diameter balls by sliding a smaller diameter barrel within said barrel and securing the smaller diameter barrel to said barrel.

3. The method of projecting a ball from a ball pitching machine as defined in claim 1 further comprising means for reducing the volume of compressed air directed against the ball to allow control of velocity of the ball projected from the ball pitching machine.

4. The method of projecting a ball from a ball pitching machine as defined in claim 1 further comprising expelling exhaust gases from the combustion chamber.

5. A ball propelling device comprising:

a) a barrel housing having an air exit;

b) a barrel at the air exit of the barrel housing wherein a ball loaded in the ball propelling device is positioned against the air exit of the barrel housing and an end of the barrel;

c) a compression chamber communicating with said barrel housing;

d) a combustion chamber connected to said compression chamber;

e) a compression piston located in said compression chamber; and f) a power piston located in said combustion chamber, said power piston connected to the compression piston; wherein g) an explosion in the combustion chamber forces the power piston and the compression piston forward, thus forming a compressed air charge in front of the compression piston, and h) said compressed air charge is directed against a ball positioned at the barrel housing exit to propel the ball out of the barrel.

6. The ball propelling device as defined in claim 5 further comprising elevation adjustment means for adjusting elevation of the barrel with respect to the ground.

7. The ball propelling device as defined in claim 5 wherein the barrel comprises:

i) a first barrel having an inside diameter;

ii) a second barrel removably positioned within said first barrel, said second barrel having an outside diameter which is slightly smaller than the inside diameter of said first barrel; and k) retainer means for holding said second barrel within said first barrel.

8. The ball propelling device as defined in claim 5 wherein the barrel includes a polymer lining on an inside surface of the barrel.

9. The ball propelling device as defined in claim 8 wherein an elastomeric strip is positioned on a longitudinal length of the barrel inside surface; and rotation means connects said barrel to said barrel housing so that the barrel can be rotated about a longitudinal axis of the barrel to change position of said elastomeric strip with respect to the ground.

10. The ball propelling device as defined in claim 5 further comprising velocity control means for reducing the charge of compressed air directed against the ball.

11. A ball propelling device comprising:

a) a barrel housing having an air exit;

b) a barrel at the air exit of the barrel housing wherein a ball loaded in the ball propelling device is positioned against the air exit of the barrel housing and an end of the barrel;

c) a compression chamber communicating with said barrel housing;

d) a combustion chamber communicating with said compression chamber;

e) a compression piston in said compression chamber;

f) a power piston in said combustion chamber;

g) a connector rod connecting said compression piston and said power piston;

h) bias means for returning the compression piston and the power piston to an initial position;

i) a gas line connected to said combustion chamber for supplying a combustible gas to the combustion chamber; and j) an igniter connected to the combustion chamber.

12. The ball propelling device as defined in claim 11 further comprising:

k) elevation adjustment means for setting the elevation of the barrel with respect to the ground.

13. The ball propelling device as defined in claim 11 further comprising:

k) azimuth adjustment means for setting the azimuthal position of the barrel.

14. The ball propelling device as defined in claim 11 further comprising k) velocity control means for controlling volume of air directed against the ball by the compression piston after an explosion in the combustion chamber.

15. The ball propelling device as defined in claim 11 wherein the barrel comprises:

k) a first barrel having an inside diameter;

l) a second barrel removably positioned within said first barrel, said second barrel having an outside diameter which is slightly smaller than the inside diameter of said first barrel; and m) retainer means for holding said second barrel within said first barrel.

16. The ball propelling device as defined in claim 11 wherein:

k) said barrel includes a polymer lining on an inside surface of the barrel;

l) an elastomeric strip is positioned on a longitudinal length of the barrel inside surface; and m) rotation means connects said barrel to said barrel housing so that the barrel can be rotated about a longitudinal axis of the barrel to change the position of said elastomeric strip with respect to the ground.

* * * * *